United States Patent [19]

Keserovich et al.

[11] Patent Number: 4,726,084

[45] Date of Patent: Feb. 23, 1988

[54] BEACH MAT APPARATUS

[76] Inventors: Slobodan Keserovich; Nikola S. Keserovich, both of 4550 La Canada Rd., Fallbrook, Calif. 92028

[21] Appl. No.: 3,590

[22] Filed: Jan. 15, 1987

[51] Int. Cl.[4] ..... A47G 9/06

[52] U.S. Cl. ..... 5/417; 5/424

[58] Field of Search ..... 5/417, 418, 419, 420, 5/425

[56] References Cited

U.S. PATENT DOCUMENTS

| | | | |
|---|---|---|---|
| 1,372,846 | 3/1921 | Temple | 5/417 |
| 2,898,609 | 8/1959 | Storie | 5/419 |
| 3,082,437 | 3/1963 | Upthagrove | 5/419 |
| 4,137,584 | 2/1979 | Sharber | 5/417 |
| 4,195,378 | 4/1980 | Parker | 5/419 |
| 4,375,111 | 3/1983 | Hall | 5/419 |
| 4,466,516 | 8/1984 | Sicoli et al. | 5/419 |
| 4,546,507 | 10/1985 | Weinstein | 5/419 |

FOREIGN PATENT DOCUMENTS

| | | | |
|---|---|---|---|
| 1044391 | 4/1953 | France | 5/419 |
| 1342629 | 1/1974 | United Kingdom | 5/417 |

*Primary Examiner*—Alexander Grosz
*Attorney, Agent, or Firm*—Henderson & Sturm

[57] ABSTRACT

A mat for use on a sandy beach which includes a rectangular shaped flexible vinyl pad having a top edge, a bottom edge and two side edges. The vinyl pad is flexible enough to fold up or roll up and is able to conform to a beach surface when in an unfolded condition. A flexible vinyl wall is attached to the top of the vinyl pad for forming a substantially rectangular compartment on the top of the vinyl pad. This wall includes a top wall spaced inwardly from the top edge, a bottom wall spaced inwardly from the bottom edge, and sidewalls spaced inwardly from the side edges of the pad. These walls are all connected together and even though they are flexible will tend to remain upright when the flexible vinyl pad is in an unfolded condition on a horizontal beach surface. Consequently, with such walls in place, sand is prevented from entering the place between the walls where a person can lie down.

5 Claims, 6 Drawing Figures

FIG. 3
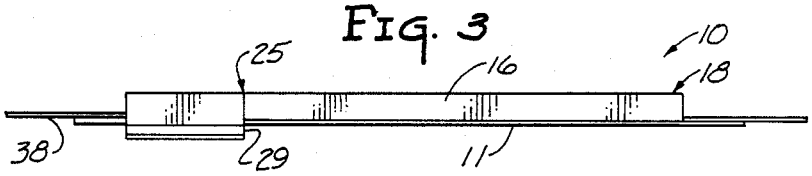
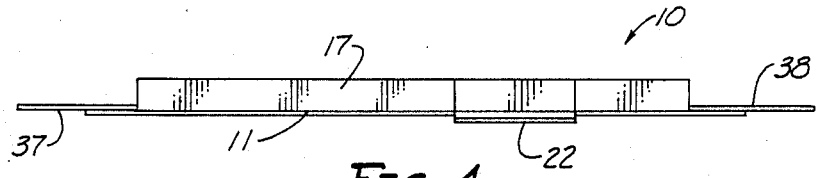
FIG. 4
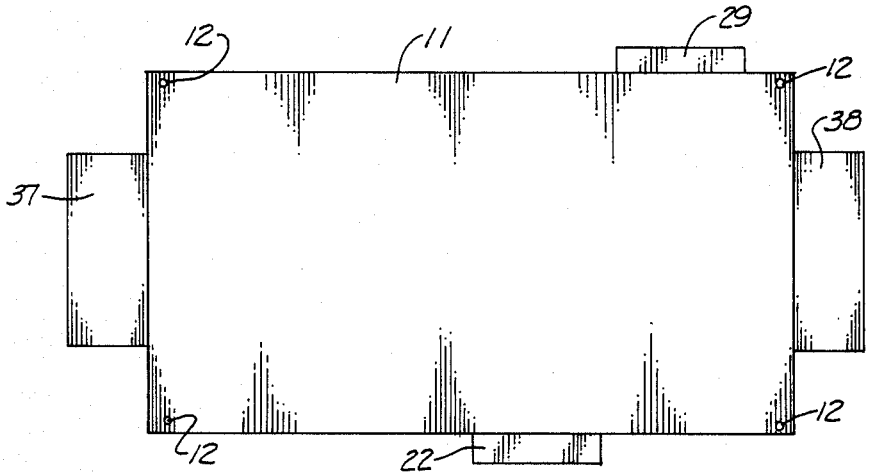
FIG. 5
FIG. 6
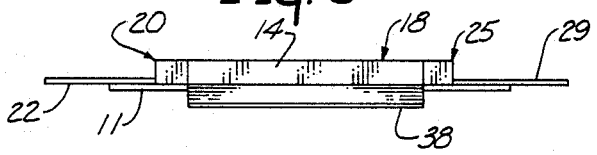

BEACH MAT APPARATUS

TECHNICAL FIELD

The present invention relates generally to a mat for lying out in the sun adjacent to water such as on a sandy beach, and more particularly to such a mat has a barrier for preventing sand from entering in the area where the person using it will lay down and still more particularly to such a device which has compartments for holding accessories useful or desirable when laying out in the sun.

BACKGROUND ART

For people swimming in an ocean or lake, it is of course a usual part of that experience to lie down on the beach during part of the time and enter the water for other parts of such time. A vast majority of people swimming on a beach use a large beach towel spread out on the sand and then they lie down on such towel. One of the problems associated with using a towel as a beach mat is that it becomes wet and sand clings to it in this condition. Consequently, when wet and sandy, it is not useful for drying off. Another problem associated with using a towel for this purpose is that a separate container or containers must be carried to the beach for holding accessories, such as suntan lotion, radios, footwear or the like. Another problem with the use of a towel or a similar mat is that when people walk by, sand gets on top of the towel or mat in the place where the user intends to lie down, therefor making it very difficult to keep sand off of the user.

When it is time to leave the beach, and the user desires to put on shoes or other footwear, it is extremely difficult to rinse the sand off of one's feet, stand on a towel that has sand on it, and then put on such footwear without retaining sand on one's feet.

U.S. Pat. Nos. 2,898,609 to Storie, 4,195,378 to Parker, 4,375,111 to Hall and 4,546,507 to Weinstein all show various types of beach mats or the like which can be folded up and taken from place-to-place. While these patented devices tend to be a considerable improvement over the common beach towel, they are not in common usage. It is surmized that one reason that such patented devices are not in common usage is that they do not solve the aforesaid problems of preventing sand from entering the place where the user is to lie down, do not provide adequate places for storage of equipment, and they do not conveniently permit a person to rinse one's feet off in an efficient manner.

DISCLOSURE OF THE INVENTION

The present invention relates to a mat for use on a sandy beach and includes a rectangular shaped flexible vinyl pad having a top edge, a bottom edge and two side edges. The vinyl pad is flexible enough to fold up or roll up and is able to conform to a beach surface when in an unfolded condition. A flexible vinyl wall is attached to the top of the vinyl pad for forming a substantially rectangular compartment on the top of the vinyl pad. This wall includes a top wall spaced inwardly from the top edge, a bottom wall spaced inwardly from the bottom edge, and sidewalls spaced inwardly from the side edges of the pad. These walls are all connected together and even though they are flexible will tend to remain upright when the flexible vinyl pad is in an unfolded condition on a horizontal beach surface. Consequently, with such walls in place, sand is prevented from entering the place between the walls where a person can lie down.

The pad can also have a plurality of compartments attached to the upstanding walls thereon, one for holding accessories, such as suntan oil or the like, one for holding a radio or the like, one for holding footwear and one for holding a container of water. A carrying case resembling a cotton pillow is useful for holding clothes and functioning as a pillow when not in use as a carrying case. Flaps are provided for covering the accessory compartments.

An object of the present invention is to provide an improved mat for laying out on the beach.

Another further object of the present invention is to provide a mat of the aforementioned type which will keep sand off of the surface on which a user is to lie down upon.

A further object of the present invention is to provide a beach mat of the aforementioned type which has compartments for holding accessories.

A still further object of the present invention is to provide a beach mat of the aforementioned type which has a compartment for holding a container of water useful to rinse one's feet before putting on footwear contained in a second compartment.

A further object of the present invention is to provide a beach mat of the aforementioned type which can be folded up or rolled up and which is compact, lightweight and inexpensive.

A still further object of the present invention is to provide compartments on a beach mat which have covers thereon, but which permit easy access to items stored therein.

Other objects, advantages and novel features of the present invention will become apparent from the following detailed description of the invention when considered in conjunction with the accompanying drawings.

BRIEF DESCRIPTION OF THE DRAWINGS

FIG. 3 is one side elevational view of the preferred embodiment of FIG. 1;

FIG. 4 is the other side elevational view of the present invention;

FIG. 5 is a bottom plan view of the preferred embodiment shown in FIG. 1; and FIG. 6 is a front end view showing what the front end of the preferred embodiment of FIG. 1 looks like.

BEST MODE FOR CARRYING OUT THE INVENTION

Figure 1:
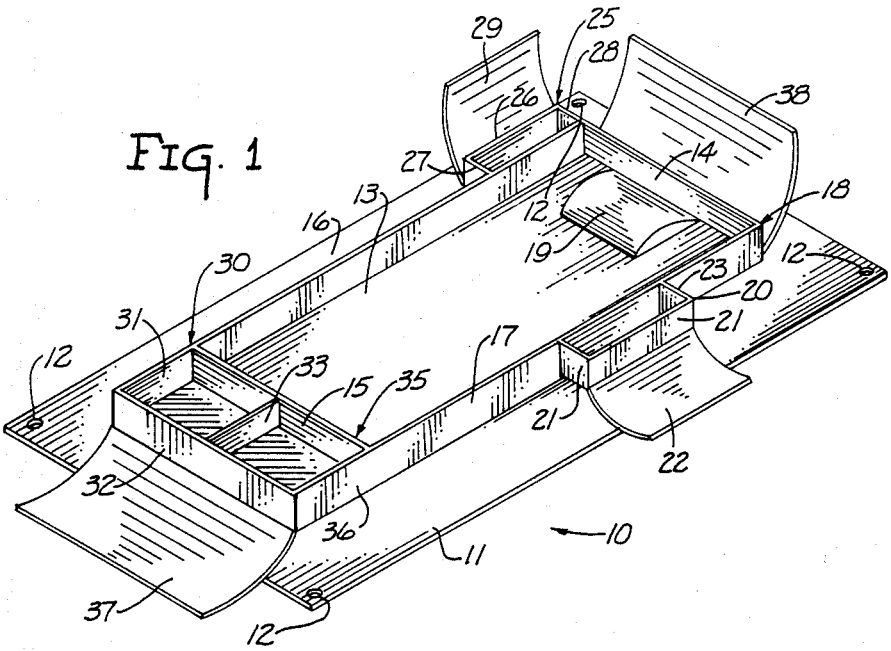
FIG. 1 is a preferred embodiment constructed in accordance with the present invention.

Referring now to the drawings, wherein like reference numerals designated identical or corresponding parts throughout the several views, FIG. 1 shows a beach mat apparatus (10) constructed in accordance with the present invention. The beach mat (10) includes a vinyl pad (11) having a plurality of grommets (12) in each corner thereof for permitting plastic tent stakes or the like to be used to hold it down on a beach and prevent it from blowing around.

A rectangular barrier is formed around a central portion (13) of the mat (11) by flexible vinyl walls including a top wall (14), a bottom wall (15) and sidewalls (16 and 17). These walls (14–17) can be formed in one piece with the pad (11), or they can be attached thereto in some other manner. Ideally, the material of the flexible walls (14–17) are constructed of the same material as the mat (11). The walls (14–17) constitute a first container (18) which will keep sand away from the central pad portion (13). A user can put a towel in the area over the top of (13) and use a pillowcase-like cloth case (19) to put the user's clothes in so that the case (19) will function as a pillow, when it is not used to hold the apparatus (10) to carry it from place-to-place.

A second container (20) also includes flexible vinyl walls (21 and 23) for holding such items as drinks, suntan lotion, sundries or the like. A flexible vinyl flap (22) is connected at one edge thereof to the bottom of the vinyl flexible wall (21) and can be flipped over the top of the second container (20) to cover up the contents therein when desired.

A third container (25) is substantially identical to the second container (20) and has vinyl flexible walls (26, 27 and 28) and a flexible flap (29) attached to the bottom of the flexible wall (26). This third compartment is useful for holding radios or any other thing that the user desires to have close to the user's head.

A fourth compartment (30) includes flexible walls (31, 32 and 33) made of a flexible vinyl material all of which are sealingly attached to the pad (11) as are the other walls previously discussed above. This fourth compartment (30) is useful to have a pan of water therein for rinsing one's feet when it is time to leave the beach and put on footwear which would typically be stored in a fifth compartment (35) consisting of walls (36, 33 and 15). A vinyl flap (37) is attached at one edge thereof to the bottom of the wall (32) and can be flipped up over the top of the fourth and fifth compartments (30 and 35) if desired. Another flap (38) is attached at one edge thereof to the bottom of the top wall (14) and can be flipped over the area where the pillow (19) is shown to be in FIGS. 1 and 2.

When it is desired to use the apparatus (10), it would be folded up or rolled up after removing the carrying case (19) from the position shown in FIG. 1. Then it would be placed in the carrying case (19) and taken to the beach just as in the case of a towel or the like. Accessories such as drinks, sundries, radios, suntan oil or the like can be rolled up or folded up in the apparatus (10) initially if desired, or these items can be carried separately to the beach.

Figure 2:
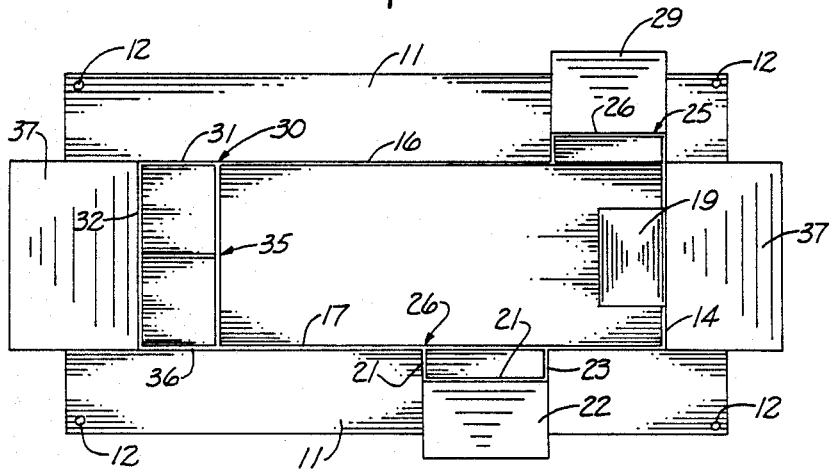
FIG. 2 is a top plan view of the apparatus shown in FIG. 1.

Once a suitable place has been found on the beach, the apparatus (10) would be removed from the carrying case (19) and rolled out to the position shown in FIGS. 1 and 2. Then certain items such as drinks or suntan lotion can be put in the first compartment (20), a radio or the like could be put in compartment (25), water could be put in the compartment (30) either directly or into a pan placed into the compartment (30) and the shoes that the person wore to the beach can be placed in the compartment (35).

The clothing from the user can be stuffed into the carrying case (19) and placed in the position shown in FIG. 1. A towel can be placed underneath the carrying case (19) and on top of the central portion (13) of the vinyl mat (11) as shown in FIG. 1 so tht the user can be conveniently lie down in the area (13) between the walls (14 and 15) and (16 and 17). When in such a position, the user has access to all of the compartments, access to all of the flaps for covering the compartments and the user's body and possessions will be shielded from sand when people walk around or toward the apparatus (10).

Obviously, many modifications and variations of the present invention are possible in light of the above teachings. It is therefore to be understood that, within the scope of the appended claims, the invention may be practiced otherwise than as specifically described.

We claim:

1. Apparatus for use on a sandy beach comprising:

a rectangular shaped flexible vinyl pad having a top edge, a bottom edge and two side edges, said vinyl pad being flexible enough to fold up and being able to conform to a somewhat horizontal beach surface when in an unfolded condition;

flexible vinyl wall means attached to the top of said vinyl pad for forming a substantially rectangular compartment on top of said vinyl pad, said wall means including a top wall spaced inwardly from said top edge, a bottom wall being spaced inwardly from said bottom edge, and sidewalls being spaced inwardly from said side edges, said sidewalls being connected to said top and bottom walls to cause all of said walls to be held up when said vinyl pad is unfolded and resting on a somewhat horizontal beach surface and yet permitting said wall means to be folded up with said vinyl pad, the distance between said sidewalls and the distance between the top and bottom walls being sufficient to allow a person to lie on said vinyl pad between said sidewalls and between the top and bottom walls;

a second flexible vinyl wall means connected to one of said sidewalls and to said vinyl pad for holding beach accessories;

a third flexible vinyl wall means connected to the other of said sidewalls and to said vinyl pad for holding recreational accessories;

a fourth flexible vinyl wall means connected to said bottom wall and to said vinyl pad for holding a container of water for rinsing the sand off of a user's feet;

a fifth flexible vinyl wall means connected to said bottom wall, said fourth flexible vinyl wall means and said vinyl pad, said fifth flexible vinyl wall means being for holding footwear; and a flap means connected to said vinyl pad for selectively covering said fourth and fifth wall means.

2. The apparatus of claim 1 including a flap means connected to said vinyl pad for selectively covering said second wall means.

3. The apparatus of claim 2 including a flap means attached to said vinyl pad for selectively covering said second wall means.

4. Apparatus for use on a sandy beach comprising:

a rectangular shaped flexible vinyl pad having a top edge, a bottom edge and two side edges, said vinyl pad being flexible enough to fold up and being able to conform to a somewhat horizontal beach surface when in an unfolded condition;

flexible vinyl wall means attached to the top of said vinyl pad for forming a substantially rectangular compartment on top of said vinyl pad, said wall means including a top wall spaced inwardly from said top edge, a bottom wall being spaced inwardly from said bottom edge, and sidewalls being spaced inwardly from said side edges, said sidewalls being connected to said top and bottom walls to cause all of said walls to be held up when said vinyl pad is unfolded and resting on a somewhat horizontal beach surface and yet permitting said wall means to be folded up with said vinyl pad, the distsance between said sidewalls and the distance between the top and bottom walls being sufficient to allow a person to lie on said vinyl pad between said sidewalls and between the top and bottom walls;

a second flexible vinyl wall means connected to one of said sidewalls and to said vinyl pad for forming a first container to hold beach accessories;

another flexible vinyl wall means connected to said bottom wall and to said vinyl pad for forming a second container;

a first flap means connected to said vinyl pad for selectively covering said first container;

a second flap means connected to said vinyl pad for selectively covering said second container; and flap means attached to said vinyl pad for selectively covering a portion of said vinyl pad inside of the first said wall means and adjacent to said top wall thereof.

5. The apparatus of claim 4 including a carrying case means of light flexible cloth for holding either clothing so the carrying case means can be used as a pillow or for holding said entire apparatus when it is folded up.

* * * * *